US005825137A

United States Patent [19]

Titus

[11] Patent Number: 5,825,137

[45] Date of Patent: Oct. 20, 1998

[54] ELECTRONIC BALLASTS FOR PLURAL LAMP FLUORESCENT LIGHTING WITHOUT FEEDBACK CIRCUITRY

[76] Inventor: Charles H. Titus, 323 Echo Valley La., Newtown Square, Pa. 19073

[21] Appl. No.: 886,235

[22] Filed: Jul. 1, 1997

Related U.S. Application Data

[63] Continuation of Ser. No. 487,802, Jun. 7, 1995, abandoned.

[51] Int. Cl.[6] ..... H05B 37/02

[52] U.S. Cl. ..... 315/291; 315/200 R; 315/224; 315/DIG. 4

[58] Field of Search ..... 315/307, DIG. 5, 315/DIG. 7, 200 R, 205, 224, 244, 241 R, 219, 291, DIG. 4

[56] References Cited

U.S. PATENT DOCUMENTS

| | | | |
|---|---|---|---|
| 4,538,095 | 8/1985 | Nilssen | 315/244 |
| 4,675,576 | 6/1987 | Nilssen | 315/242 |
| 4,698,554 | 10/1987 | Stupp et al. | 315/307 |
| 5,173,643 | 12/1992 | Sullivan et al. | 315/276 |
| 5,192,896 | 3/1993 | Qin | 315/224 |
| 5,192,897 | 3/1993 | Vossough et al. . | |
| 5,233,273 | 8/1993 | Waki et al. | 315/224 |
| 5,323,090 | 6/1994 | Lestician | 315/291 |
| 5,334,915 | 8/1994 | Ohsaki et al. | 315/307 |
| 5,363,020 | 11/1994 | Chen et al. | 315/209 R |
| 5,539,281 | 7/1996 | Shackle et al. | 315/224 |

*Primary Examiner*—Don Wong
*Assistant Examiner*—David H. Vu
*Attorney, Agent, or Firm*—Caesar, Rivise, Bernstein, Cohen & Pokotilow, Ltd.

[57] ABSTRACT

A non-dimmable electronic ballast has a unique inverter design which eliminates a large percentage of the required components, thereby simplifying and increasing the reliability of the ballast, while decreasing its costs. The ballast can provide power for either two or four fluorescent lamps and has additional safety and protection features which are not available in existing ballasts. A dimmable version is also disclosed with a dimming control at the ballast or which can operate a bank of ballasts with a central, remote dimming control or which can provide a variable output frequency to the ballasts to dim the lamps. There is very little distributed capacitance at the connections from the electronic ballast to the lamps. This feature eliminates points of resonances over the range of frequencies for dimming, thereby eliminating sudden changes in brightness as the frequency is varied.

16 Claims, 4 Drawing Sheets

ELECTRONIC BALLASTS FOR PLURAL LAMP FLUORESCENT LIGHTING WITHOUT FEEDBACK CIRCUITRY

This application is a continuation, of application Ser. No. 08/487,802, filed Jun. 7, 1995 now abandoned.

BACKGROUND OF THE INVENTION

This invention relates generally to electronic ballasts for fluorescent lamps, and more particularly to electronic ballasts for fluorescent lamps, which operates in the high frequency range and which, depending upon the embodiments, provides both dimmable and non-dimmable lighting.

Various types of electronic ballasts are known. Magnetic ballasts operate at the frequency of the input power sources, e.g., at 50 or 60 Hz. In recent years, it has been recognized that a considerable increase in efficiency, i.e., the amount of power expended in relation to the lumen output of fluorescent lights, can be obtained, in the order of 40%, if the lamps are operated at higher frequencies, e.g., at frequencies between 30 and 50 KHz, for the non-dimmable ballasts.

These electronic ballasts comprise an input circuit with surge protection, a thermal switch for protection against equipment failures or short circuits, and a noise filter circuit; a full wave rectifier, usually a diode bridge with a smoothing filter across its output; an inverter with an amplifier and a second DC power supply; and an output transformer which is connected to the fluorescent lamps.

The most common fluorescent lamp ballasts are non-dimmable. They have no manual control of the amount of light emitted by the fluorescent lamps. But recently, dimmable types of high frequency ballasts have been disclosed which use a voltage to frequency converter, an amplifier, and a second DC power supply in the inverter, and apply power to the lamps over a frequency range. One such electronic dimmable ballast is disclosed in U.S. Pat. No. 5,192,897 (Vossough et al.). The lamp brightness varies in proportion to the frequency of the power applied to the lamps.

A problem with many of the existing ballasts is that the secondary of the output transformer, which is connected to the lamps is not fully isolated from the primary of the transformer, allowing for a feed back path to the AC power source. This creates a hazardous condition when lamps are being changed because the exposed socket can carry 50 or 60 Hz power. Whereas high frequency power (in the order of 30 or 50 KHz) can cause a burn if the skin is exposed to it, 50 or 60 Hz power can cause shock or electrocution.

While some prior art electronic ballasts may be generally suitable for their intended purposes, they nevertheless leave something to be desired from one or more of the following standpoints: safety, reliability, ability to provide power to multiple lamps, simplicity of construction, and cost. Furthermore, there is a need for dimmable ballasts which protect against points of resonance over the range of input frequencies, which cause "blooming" (increased brightness, then dimming), at specific resonant frequencies.

OBJECTS OF THE INVENTION

Accordingly, it is the general object of the instant invention to provide electronic ballasts for fluorescent lighting which improves upon present electronic ballasts.

It is a further object of this invention to provide electronic ballasts for fluorescent lighting, each of which is capable of operating a bank or load of either two or four fluorescent lamps.

It is a further object of this invention to provide electronic ballasts for fluorescent lighting which are simple in construction.

It is a further object of this invention to provide electronic ballasts for fluorescent lighting which are low in cost.

It is still a further object of this invention to provide electronic ballasts for fluorescent lighting which incorporates more safety and protection against equipment failure or short circuits than existing electronic ballasts.

It is still another object of this invention to provide electronic ballast for fluorescent lighting which effectively protects against noise and interference to electronic equipment in the facility where the fluorescent lamps are installed.

It is still another object of this invention to provide electronic ballasts for fluorescent lighting which exhibit a positive and rapid start-up when power is applied.

It is still another object of this invention to provide electronic ballasts for fluorescent lighting which are capable of restarting the lamps in a very short time period after the power has been turned off.

It is still another object of this invention to provide electronic ballasts for fluorescent lighting which do not present a shock or electrocution hazard when the fluorescent lamps are removed from their sockets leaving the sockets exposed.

It is yet another object of this invention to provide dimmable and non-dimmable electronic ballasts for fluorescent lighting which achieve the above objects.

It is yet another object of this invention to provide a dimmable electronic ballast for fluorescent lamps including a control which can be located at a central location remote from the fluorescent lamp load.

It is yet another object of this invention to provide a dimmable electronic ballast for fluorescent lighting, wherein the ballast is capable of operating one or more banks or loads of plural fluorescent lamps.

It is yet another object of this invention to provide a dimmable ballast for fluorescent lighting which does not exhibit points of resonance over the range of frequencies applied to the fluorescent lamps to effect their dimming control.

It is yet another object of this invention to provide a dimmable electronic ballast for fluorescent lighting which uses a remote input of high frequency from a central source.

SUMMARY OF THE INVENTION

These and other objects of the instant invention are achieved by providing electronic ballasts for operating a lighting load of at least two fluorescent lamps from a conventional source of AC power, e.g., 110V, 220V, 240V, and 277V, at 50–60 Hz. The ballasts comprise non-dimmable ballasts and dimmable ballasts.

In accordance with one preferred aspect of this invention the non-dimmable ballast comprises, a protection and noise filter circuit, a rectifier and DC filter circuit, an inverter circuit, and an output circuit. The protection and noise filter circuit is arranged to be connected to the source of AC power. The rectifier and DC filter circuit is coupled to the protection and noise filter circuit to provide DC power. The inverter circuit is coupled to the rectifier and DC filter circuit for receipt of the DC power therefrom. The inverter circuit includes a tuned resonant circuit comprising a first capacitor connected in parallel with a tapped inductor. The output circuit comprises an output transformer coupled to the lamps of the load and is arranged for receipt of the high frequency electrical signal from the inverter circuit.

In accordance with another preferred aspect of this invention the dimmable ballast comprises, a control circuit having a dimming control, a voltage-to-frequency conversion circuit connected to the control circuit, a protection and noise filter circuit, a rectifier circuit, an inverter circuit, and an output circuit. The voltage-to-frequency conversion circuit provides an output signal of a variable frequency in response to the dimming control. The frequency is in the range of approximately 20 and 250 KHz. The dimmable ballast additionally comprises means for preventing resonant frequencies over that frequency range.

In accordance with preferred embodiments of the ballasts of this invention the output circuit for both the non-dimmable and the dimmable ballasts comprises a reactor connected to the output transformer and to the lamps. The reactor has a core and a pair of windings wound about the core in a manner which reduces the distributed capacitance in the reactor and in the output transformer. The reactor is connected to and provides power for operating a lighting load of two or four fluorescent lamps. Each of the windings of the reactor has a first and a second end, with the first ends being connected together and with the second ends being connected to the lamps. The windings are wrapped around the core with the first ends being close to the core and with the second ends being further from said core than the first ends.

DESCRIPTION OF THE DRAWINGS

Other objects and many of the intended advantages of this invention will be readily appreciated when the same becomes better understood by reference to the following detailed description when considered in connection with the accompanying drawings wherein.

DETAILED DESCRIPTION OF THE PREFERRED EMBODIMENTS

Figure 1:
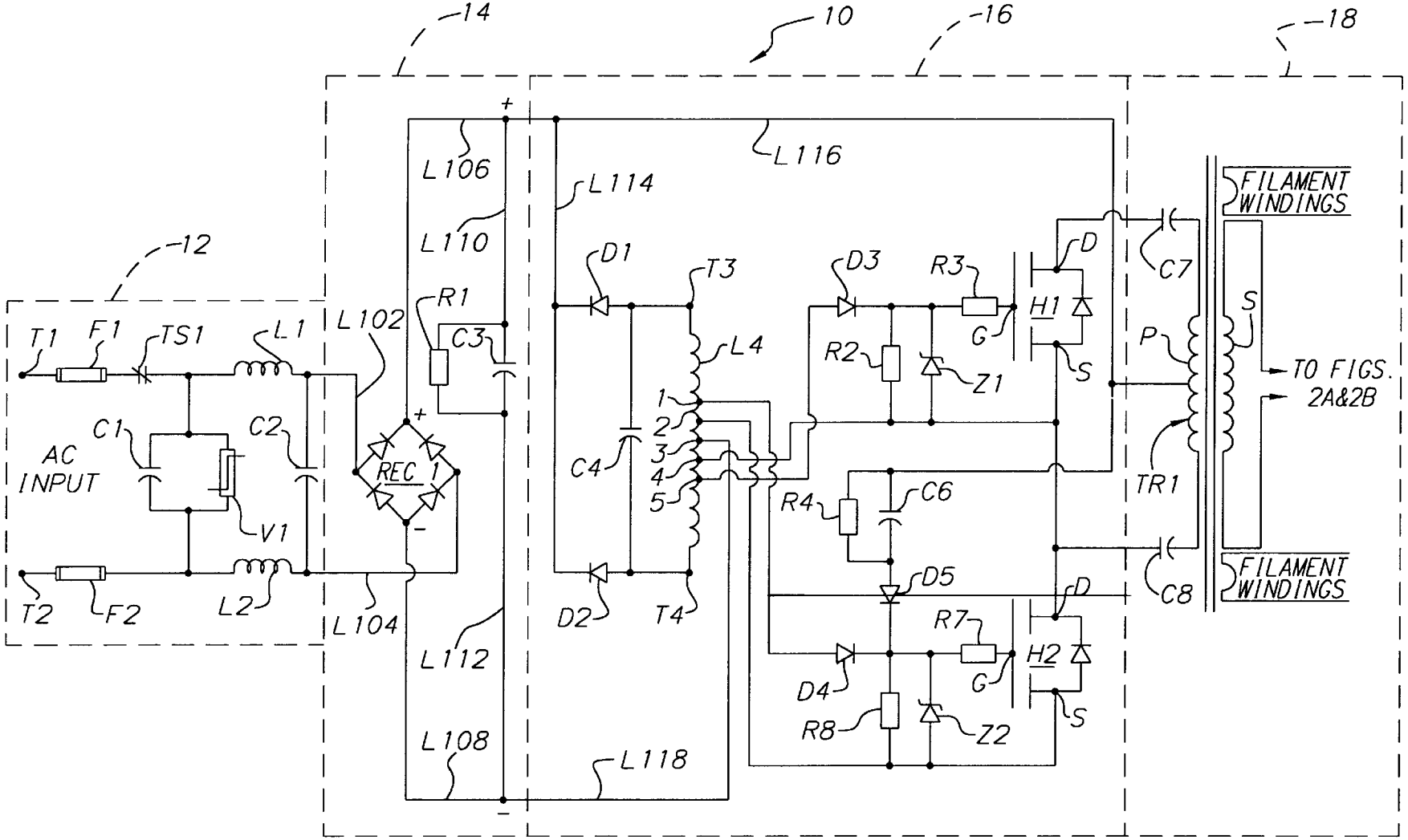
FIG. 1 is a schematic diagram of one preferred embodiment of a non-dimmable electronic ballast constructed in accordance with this invention.

Referring now in greater detail to the various figures of the drawing, wherein like reference characters refer to like parts, there is shown in FIG. 1 a preferred embodiment of a non-dimmable electronic ballast 10 constructed in accordance with the subject invention. The ballast 10 basically comprises a protection and noise filter section 12, a rectifier and DC filter section 14, an inverter section 16, and an output transformer section 18 to which the fluorescent lamp load is connected.

Figure 2A:
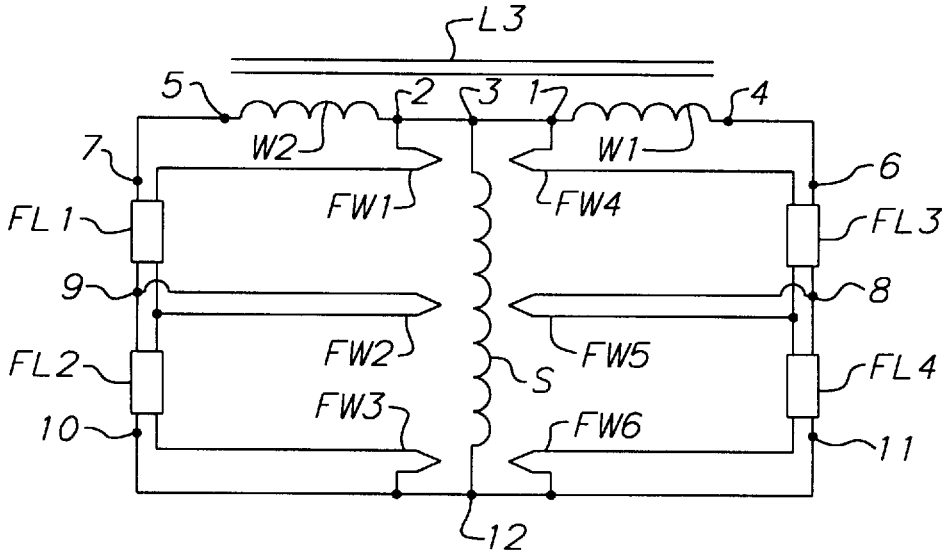
FIG. 2A is a schematic diagram of one exemplary load circuit of four fluorescent lamps to be driven by the non-dimmable electronic ballast of FIG. 1 or the dimmable electronic ballasts of FIG. 3A–3D.
Figure 2B:
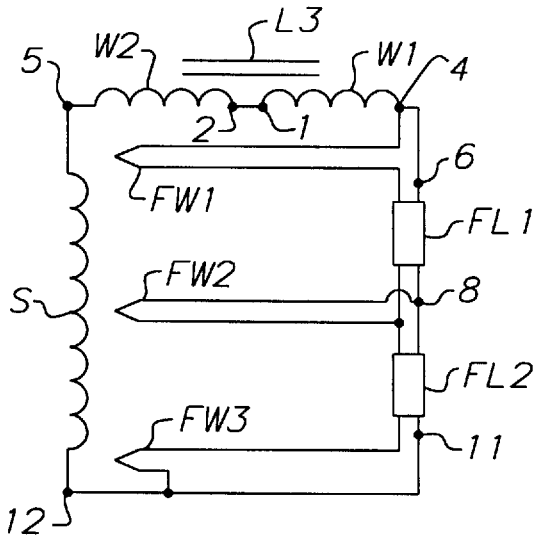
FIG. 2B is a schematic diagram of one exemplary load circuit of two fluorescent lamps to be driven by the non-dimmable electronic ballast of FIG. 1 or the dimmable electronic ballasts of FIGS. 3A–3D.

The ballast 10 is arranged to drive or power a bank or lighting load composed of plural fluorescent lamps. In particular, the load may comprise two or four conventional fluorescent lamps connected in several ways. For example, in FIG. 2A there is shown one exemplary four-lamp load, wherein two conventional fluorescent lamps, FL1 and FL2, are connected in series with each other, and are connected in parallel to the series connection of two other conventional fluorescent lamps, FL3 and FL4. In FIG. 2B there is shown one exemplary two-lamp load. In this embodiment two conventional fluorescent lamps, FL1 and FL2, are connected in series. It should be pointed out at this juncture that while the loads of FIGS. 2A and 2B are preferred, other arrangements of multiple lamp loads (e.g., four lamps in series, or four lamps in parallel) can be driven by the ballasts of this invention. Moreover, the non-dimmable ballast 10, as well as the dimmable ballast 20 (to be described later), can be used with any conventional source of AC power, e.g., 120V, 220V, 240V or 277V at 50 Hz to 60 Hz.

In accordance with one preferred of this invention, the sections 12, 14, 16 and 18 of the ballast 10 are assembled as a one unit arranged to be located at the fluorescent lamp load. In some applications the output transformer section 18 and the fluorescent lamp load can form a separate unit. In such an alternative arrangement, the unit composed of the output transformer section 18 and the lamp load can be located remotely from the unit composed of sections 12, 14, and 16, but will be electrically connected thereto by suitable insulated electrical cable.

The input to the protection and noise filter section 12 is in the form of a pair of terminals T1 and T2 to which conventional 50 or 60 Hz, AC power is applied. The protection and noise filter section 12 basically comprises a pair of fuses F1 and F2, a thermal switch TS1, a surge suppressor (which in the preferred embodiment shown herein is a metal-oxide-varistor) V1, two inductors L1 and L2, and two capacitors C1 and C2.

As can be seen in FIG. 1, one side of the fuse F1 is connected to the terminal T1, while the corresponding side of the fuse F2 is connected to the terminal T2. The thermal switch TS1 is connected to the other side of the fuse F1. One side of the varistor V1 and one side of a parallel connected capacitor C1 is connected to the other side of the thermal switch TS1 and to one side of the inductor L1. The other side of the parallel combination of the varistor V1 and the capacitor C1 is connected to the other side of the fuse F2 and to one side of the inductor L2. The capacitor C2 is connected across the other sides of the inductors L1 and L2. A pair of conductors or lines L102 and L104 are connected to the inductors L1 and L2, respectively, and serve as the output of the protection and noise filter circuit 12. The output lines L102 and L104 also serve as the input lines of the rectifier and DC filter section 14 (to be described later).

As will be appreciated by those skilled in the art, the capacitor C1 and C2, the varistor V1 and the inductors L1 and L2 constitute an electrical surge and noise suppression system. This system serves to prevent surges from the AC power system from entering the ballast and either damaging it or causing it to malfunction. In addition, the protection and noise filter section 12 prevents electrical noise which may be generated in the ballast from propagating back into the AC power system, which action might disturb sensitive electronic equipment, such as computers and the like, connected to the power system. The thermal switch TS1 serves to protect the equipment in case of malfunctions or short-circuits.

The rectifier and DC filter section 14 basically comprises a single phase, full-wave, solid state (e.g., diode) bridge rectifier REC1 and a DC filter capacitor C3 connected in parallel with a resistor R1. The positive output terminal of the rectifier REC1 is connected by a line L106 and a line L110 to one side of the resistor R1 and to one side of the capacitor C3. The negative output terminal of the rectifier REC1 is connected by the lines L108 and L112 to the other side of the resistor R1 and to the parallelly connected capacitor C3. The lines L106 and L108 serve as the positive and the negative DC output lines, respectively, of the rectifier and DC filter section 14 and also serve as the inputs to the inverter section 16, to provide DC power to the inverter section.

The inverter section 16 is arranged to provide high frequency output power for the fluorescent lamps to which the subject ballast is connected. The construction of the inverter circuit 16 renders it very efficient and easy to start. Moreover, it requires relatively few components and has a long life under adverse conditions of heat and cold.

In accordance with one preferred aspect of this invention the inverter section 16 includes a resonant circuit tuned to the desired frequency, e.g., approximately 40 KHz, and connected to a pair of metal oxide semiconductor field effect junction transistors (power MOSFETs), e.g., such as those sold under the trademark HEXFET by International Rectifier, H1 and H2. The HEXFETs H1 and H2 are coupled to the primary P of an output transformer TR1 in the output transformer section 18. In particular, the resonant circuit comprises a multi-tapped inductor L4 connected in parallel with a capacitor C4. One side of the inductor L4 is provided at a terminal T3 which is connected to one side of the capacitor C4 and to the anode of a diode D1. The other side of the inductor L4 is provided at a terminal T4 which is connected to the other side of the capacitor C4 and to an anode of a diode D2. The cathodes of the diodes D1 and D2 are connected together, via a line L114, to the line L110, i.e., the line having the positive DC voltage from the rectifier REC1.

The inductor L4 includes five taps, designated by the reference numbers, 1, 2, 3, 4 and 5, and is connected between a pair of terminals T3 and T4. Tap 3 is connected to a line L118, i.e., the -DC voltage at the rectifier REC1. Tap 1 is connected to the anode of a diode D4. The cathode of the diode D4 is connected to the common junction of the cathode of a diode D5, one side of a resistor R8, the cathode of a zener diode Z2, and one side of a resistor R7. The other side of the resistor R8 and the anode of the zener diode Z2 are connected together to tap 2 of the inductor L4. They are also connected to the source S of the HEXFET H2. The anode of the diode D5 is connected to the common junction of a resistor R4 and a capacitor C6. Tap 4 of the inductor L4 is connected the common juncture of one side of a resistor R2, the anode of a zener diode Z1, the drain D of the HEXFET H2, and the source S of the HEXFET H1. Tap 5 of the inductor L4 is connected to the anode of a diode D3. The cathode of the diode D3 is connected to the common junction of the other side of the resistor R2, the cathode of zener diode Z1, and one side of a resistor R3. The other side of resistor R3 is connected to the gate G of the HEXFET H1. The other side of resistor R7 is connected to the gate G of the HEXFET H2. The other side of the resistor R4 and the capacitor C6 is connected, via a line L116, to the common junction of the lines L106 and L110 (and to the primary P of the output transformer TR1, to be described later).

The DC voltage provided by rectifier REC1 across the lines L106 and L108 is 1.414 times the RMS AC voltage supplied to the ballast from the power source. No amplifier or separate low voltage power supply is required by the ballast 10 of this invention, as is the case with prior art ballasts. This feature provides for greater simplicity, efficiency, reliability, and lower costs by decreasing the total number of components required of the ballast.

The output of the inverter section 16 is provided by a pair of lines connected to the respective drains D of the two HEXFETs H1 and H2. These lines serve as the inputs to the output transformer section 18. That section's details will be described later. Suffice it for now to say that the output transformer section comprises the heretofore identified output transformer TR1. The output transformer includes a primary winding P and a high voltage output winding S which is isolated from the primary winding. The output transformer section also includes plural filament windings (to be identified later) which supply high frequency power continuously to all of the fluorescent lamp filaments to provide for rapid starting of the lamps at 0° F. while ensuring long lamp life.

The operation of the inverter section 16 will now be described. The steady state DC voltage present between the positive and negative terminals of the rectifier REC1, as provided on the lines L106 and L108, respectively, is approximately 169 volts DC when 120 volts AC RMS is applied to the AC input terminals of the rectifier by the lines L102 and L104. The resistor R1 of the rectifier and filter section 14 acts as a high resistance bleeder to discharge the associated capacitor C3. This action creates a short duration positive polarity pulse to appear on line L116 when AC power is applied to the ballast. The pulse passes through the parallel combination of the capacitor C6 and the resistor R4 and then to diode D5 through the resistor R7 to the gate of the HEXFET H2. This action causes the HEXFET H2 to conduct. The conduction of the HEXFET H2 results in current flowing from its source S into tap 2 of the inductor L4, thereby completing a circuit back to the negative terminal of the rectifier REC1 output through tap 3 of inductor L4 and its connected line L118.

The pulse of current into tap 2 and out of tap 3 of the inductor L4 causes the inductor to act like an autotransformer, thereby charging the capacitor C4 connected in shunt across the inductor L4. The inductance of the inductor L4 and the capacitance of the capacitor C4 are chosen so that the parallel resonant circuit created thereby oscillates at a frequency of approximately 40 KHz.

The initial charging of the capacitor C4 causes the terminal T3 which is connected at one end of the inductor L4 and the tap 2 of that inductor to each be positive relative to tap 3. At the same time, the terminal T4 at the other end of the inductor L4 and tap 4 will each be negative relative to tap 3. This action insures that the HEXFET H1, with its source S connected to tap 4 does not conduct current, but that HEXFET H2 does conduct current. Since the inductor L4 and the capacitor C4 oscillate at a frequency of approximately 40 KHz, approximately 12.5 microseconds later, current will begin to flow in the opposite direction in the resonant circuit. This action causes terminal T4 and tap 4 of the inductor L4 to become positive, while at the same time, terminal T3 and tap 2 become negative. This reversal of polarity causes the HEXFET H2 to cease conducting current and the HEXFET H1 to start conducting current. The oscillating condition continues until the AC power is shut off and all capacitors are effectively discharged by virtue of the energy dissipated in lighting the fluorescent lamps and supplying the small amount of energy lost in the various components making up the ballast.

It should be pointed out at this juncture that it is essential that a significant amount of energy be dissipated before the AC input to the ballast 10 is re-energized. Otherwise the gate G of the HEXFET H2 which is connected to the serially connected capacitors C6, the diode D5, and the resistor R7 may not have a sufficient rise in positive voltage (5–10 volts) between it and the source S of the HEXFET H2 to cause that HEXFET to conduct current between its drain D and its source S. Such action is necessary for oscillations to take place between the inductor L4 and the capacitor C4.

The diodes D1 and D2 insure the maximum voltage which can appear between the terminals T3 and T4 of the oscillatory circuit made up of the inductor L4 and the capacitor C4 could not significantly exceed the normal DC voltage applied to the capacitor C3. This condition is true even if there is a short circuit on the secondary winding S of the output transformer TR1 in the output transformer section 18. Also, the diodes D1 and D2 prevent the voltage between the terminals T3 and T4 exceeding twice the DC voltage across the capacitor C3, regardless of whether all the fluorescent lamps to which the ballast is connected are functioning normally, or are removed, or the ballast is open or short circuited.

As will be appreciated by those skilled in the art, the capacitor C6, the resistor R4 and the diode D5 make up a "starting circuit" for the inverter section 16. When the AC input has been turned off, the ballast 10 functions in a normal manner until approximately 75% of the energy stored in the capacitor C3 has been dissipated. At this time the voltage appearing on capacitor C3 will have decreased to 50% of its operating level. Thus, the AC power can be turned on again less than 1 second after it has been switched off. Since the starting circuit can quickly start oscillations in the resonant circuit the fluorescent lamps of the load supplied by the ballast 10 will be relit quickly.

The capacitance of capacitor C6 is chosen to be relatively low and the resistance of resistor R4 relatively high. This enables the capacitor to discharge rapidly, while the current through the resistor R8 is held low. Thus, the voltage across the resistor R8 will be sufficiently low so the gate-to-source voltage on the HEXFET H2 will be such that the HEXFET will only turn on to conduct current from its drain D to its source S during lamp starting or when the voltage at tap 1 of the inductor L4 is more positive than the voltage at tap 2. This latter event occurs when the resonant circuit is oscillating at its resonant frequency. The diodes D3 and D4 assure that only positive voltages are applied to the gates of the HEXFETs H1 and H2 at the proper time. The resistors R3 and R7 limit the current to the gates G of the HEXFETs H1 and H2, respectively and also prevent undesirable oscillations in these circuits. The zener diode Z1 serves to clamp the gate voltage applied to the HEXFET H1 to a safe value, while the zener diode Z2 performs the same function with respect to the HEXFET H2.

As mentioned earlier, the drains of the HEXFET H1 and H2 are connected via respective lines serving as the output of the inverter section 16. These lines also serve as the input to the output transformer section 18. To that end the lines from the drains of the HEXFETs H1 and H2 and are connected to corresponding sides of a pair of capacitors C7 and C8 in the output transformer section 18. The capacitors C7 and C8 are connected to respective ends of the primary P of the output transformer TR1. The capacitors prevent any DC bias caused by unequal conduction of the HEXFETs H1 and H2 from saturating the core of the output transformer TR1 or from otherwise causing excessive current to flow through the HEXFETs. The primary winding P includes a center tap which is connected to the junction of a line L116 and the common junction of the resistor R4 and the capacitor C6 in the inverter section 16.

As will be appreciated by those skilled in the art the inverter section 16, as described above, is a current-driven circuit. Alternatively, it can be arranged to be a voltage-driven circuit, with a resonant circuit connected directly in parallel with the load, rather than as an inverter which has a resonant circuit connected between the HEXFETs H1 and H2. In such an alternative construction the resonant circuit is connected in parallel with the primary winding of the output transformer. The resonant circuit can be a parallel resonant circuit or a series resonant circuit. In either case, the resonant circuit will not be influenced by the impedance of the load on the output transformer because the impedance of the source, which is in series with the load and the resonant circuit, is very small. Therefore, a change in the load impedance will have very little, if any, effect on the frequency of the oscillating circuit.

While alternative constructions of the inverter section 16 are contemplated, the inverter in the preferred embodiment of ballast 10, as discussed above, is preferable to alternate circuitry using a series resonant circuit or a parallel resonant circuit, because less components are required for the ballast, and because the starting circuit operates in a more positive fashion.

As should also be appreciated by those skilled in the art from the foregoing the ballast 10 offers many distinct advantages over the existing ballasts in that it requires a low component count, e.g., only approximately 30 to 35 components, as opposed to existing ballasts which require many more, e.g., 60 to 90, components. This substantial reduction in a number of components required results in a ballast which is lower in cost, which can be made smaller in size, and which is of greater simplicity of construction. This later feature results in increased reliability of the ballast and greater ease in manufacturing it.

The details of the output transformer section 18 will now be described. To that end, as mentioned earlier the output transformer TR1 includes the primary winding P and the secondary winding S. The secondary winding S is fully isolated from the primary winding P. The capacitors C7 and C8 prevent any DC bias caused by any unequal conduction times of the HEXFETs H1 and H2 from saturating the core of the transformer TR1 or otherwise causing excessive current flow through the HEXFETs. The high voltage secondary winding S of the transformer provides electrical isolation of the lamp circuits from the 50 or 60 Hz AC power circuit, thereby preventing electrical shock injury, e.g., electrocution, of any person touching a live portion of the lamp circuit driven by the ballast 10.

In FIGS. 2A and 2B there are shown two load circuits composed of plural fluorescent lamps which can be readily driven by the output transformer section 18 of the ballast 10. In FIG. 2A a four fluorescent tube load is shown, while FIG. 2B shows a two fluorescent tube load. Either of the two loads shown in FIGS. 2A and 2B can be driven by the output transformer section 18.

The use of the ballast 10 with a four fluorescent lamp load circuit, like that of FIG. 2A, will now be described. To that end as can be seen, the load basically comprises four conventional fluorescent lamps, FL1, FL2, FL3, and FL4, and a reactor L3. The reactor L3 includes two windings W1 and W2. Terminal 1 of the winding W1 is connected to terminal 2 of the winding W2 and to one side of the secondary winding S of the output transformer TR1 via terminal 3. The high voltage end of winding W2 is provided at terminal 5. This terminal is connected to the high voltage inputs of lamps FL1 and FL2, via terminals 7, 9 and 10. Terminal 10 is connected to the other end of the secondary winding S via terminal 12. The high voltage end of the winding W1 is provided at terminal 4. This terminal is connected to the high voltage inputs of lamps FL3 and FL4 via terminals 6, 8 and 11. Terminal 11 is also connected to the other end of the secondary winding at terminal 12.

The filament windings for the fluorescent lamps FL1–FL4 are designated as FW1, FW2, FW3, FW4, FW5 and FW6 and are connected as shown. In particular, the filament winding FW1 provides power for heating one filament of the lamp FL1, and the filament winding FW2 provides power for heating the second filament of the lamp FL1 and one filament of the lamp FL2. The filament winding FW3 provides power for heating the second filament of the lamp FL2. In a similar manner, the filament winding FW4 provides power for heating one filament of the lamp FL3, and the filament winding FW5 provides power for heating the second filament of the lamp FL3 and one filament of the lamp FL4. The filament winding FW6 provides power for heating the second filament of the lamp FL4.

At this juncture, it is important to note that the windings W1 and W2 are wound about the core of the reactor L3 in a manner to minimize the distributed capacitance of the output transformer section. In this regard, the ends of the windings W1 and W2 at terminals 1 and 2 are connected together and placed close to the core of the reactor. As the coils are wound, the other ends of the windings W1 W2 at terminals 4 and 5 are positioned further from the core. Therefore, the distributed capacitance at terminals 4 and 5 is minimized. This feature is of particular importance which regard to the dimmable ballasts, such as those shown in FIGS. 3A–3D. The dimmable ballasts of this invention will be discussed later. Suffice it for now to state, they are designed to operate over a wide frequency range, e.g., from 20 and 250 Khz. Minimizing the distributed capacitance in the reactor L3 and the output transformer TR1 prevents the occurrence of points of resonance at various frequencies throughout that range. Such points of resonance could result in sudden dimming or increasing (blooming) of the lamps' light output as the frequency is varied over the range.

The manner of winding the windings W1 and W2 about the core of the reactor L3 is the same for the two lamp configuration of FIG. 2B and for the four lamp configuration of FIG. 2A. Therefore, in either case, the distributed capacitance of the output transformer section is extremely low, to eliminate the occurrence of points of resonance in the frequency range used to operate the dimmable ballast.

Referring now to FIG. 2B the wiring configuration of a load circuit of two fluorescent lamps FL1 and FL2 will now be described. Thus, in this embodiment of the load circuit the terminals 1 and 2 of the reactor L3 windings W1 and W2, respectively, are connected together. The other end of the winding W2 is provided at terminal 5 and is connected to one side of the secondary winding S of the output transformer TR1. The other terminal of the winding W1 is provided at terminal 4 and is connected to the high voltage inputs of the lamps FL1 and FL2 at terminals 6, 8 and 11. The terminal 11 of the lamp FL2 is connected to the other side of the secondary winding of the transformer TR1 at the terminal 12. The filament windings FW1, FW2 and FW3 provide power for heating the filaments of tho lamps FL1 and FL2. In particular, the filament winding FW1 provides power for heating one filament of the lamp FL1, the filament winding FW2 provides power for heating the second filament of the lamp FL1 and for heating one filament of the lamp FL2. The filament winding FW3 provides power for heating the second filament of the lamp FL2.

As should now be evident, the basic difference between the configurations of the loads of FIGS. 2A and 2B is that in FIG. 2A the secondary winding S of the transformer TR1 is connected to the junction between the windings W1 and W2 of the reactor L3, whereas, in the configuration of FIG. 2B the secondary winding S of the output transformer is wired to one side of the winding W2 and through the high voltage inputs of the lamps FL1 and FL2 to the other side of that winding. Thus, with slight wiring changes the ballasts of this invention can be used to drive two or four fluorescent lamp loads.

Reference is now made to FIGS. 3A, 3B, 3C and 3D wherein the details of dimmable ballasts constructed in accordance with this invention will be described. Prior to a description of those circuits in detail, a general description of them is in order. To that end the dimmable ballasts of this invention are arranged to provide power to one or more banks of plural fluorescent lamps over a frequency range of 20 KHz to 250 KHz. The light intensity of the fluorescent lamps of the load will vary in accordance with the frequency of the power provided to the lamps by the ballasts. The dimmable ballasts can take various embodiments, e.g., the combination of the circuitry 20A, 20B and 20C (shown in FIGS. 3A, 3B and 3C, respectively), the combination of the circuitry 20A, 20B and 20D (shown in FIGS. 3A, 3B and 3D, respectively), etc. Thus, the circuitry of FIGS. 3A–3D can be connected and arranged in various alternative embodiments of the dimmable ballasts. For example, in a "first" embodiment the circuits 20A, 20B and 20C are connected together in a unit (as will be described later) and the unit is located at the lamps, i.e., at a "remote" location.

In a "second" alternative embodiment the circuits 20A and 20C are connected together as a unit (as will also be described later) and that unit is located at the location of the lamps. In this embodiment, the circuit 20B also forms a portion of that ballast and serves as the control for the ballast, but is located at a central location. In this case, as will be explained later, the circuit 20B provides a regulated ±24 Volt and variable 0–10 Volt DC outputs via a four conductor shielded cable from the circuit 20B at central location to the circuits 20A and 20 at the remote location with the lamp load. In a "third" alternative embodiment, the circuits 20A and 20D are connected together as a unit (as will also be described later) and that unit is located at the remote location of the lamps.

In this embodiment the circuit 20B is located at the central location (as in the second embodiment of the dimmable ballast). A voltage-to-frequency converter (to be described later) is added to the circuitry and is connected to ±24 volt and the 0–10 volt outputs of the circuit 20B at a central location. The variable high frequency output of the voltage-to-frequency converter at the central location is provided to the circuit 20D in the unit located at the lamps via a coaxial cable (not shown). The centrally located unit can be used to control plural banks of multiple fluorescent lamps.

Figure 3A:
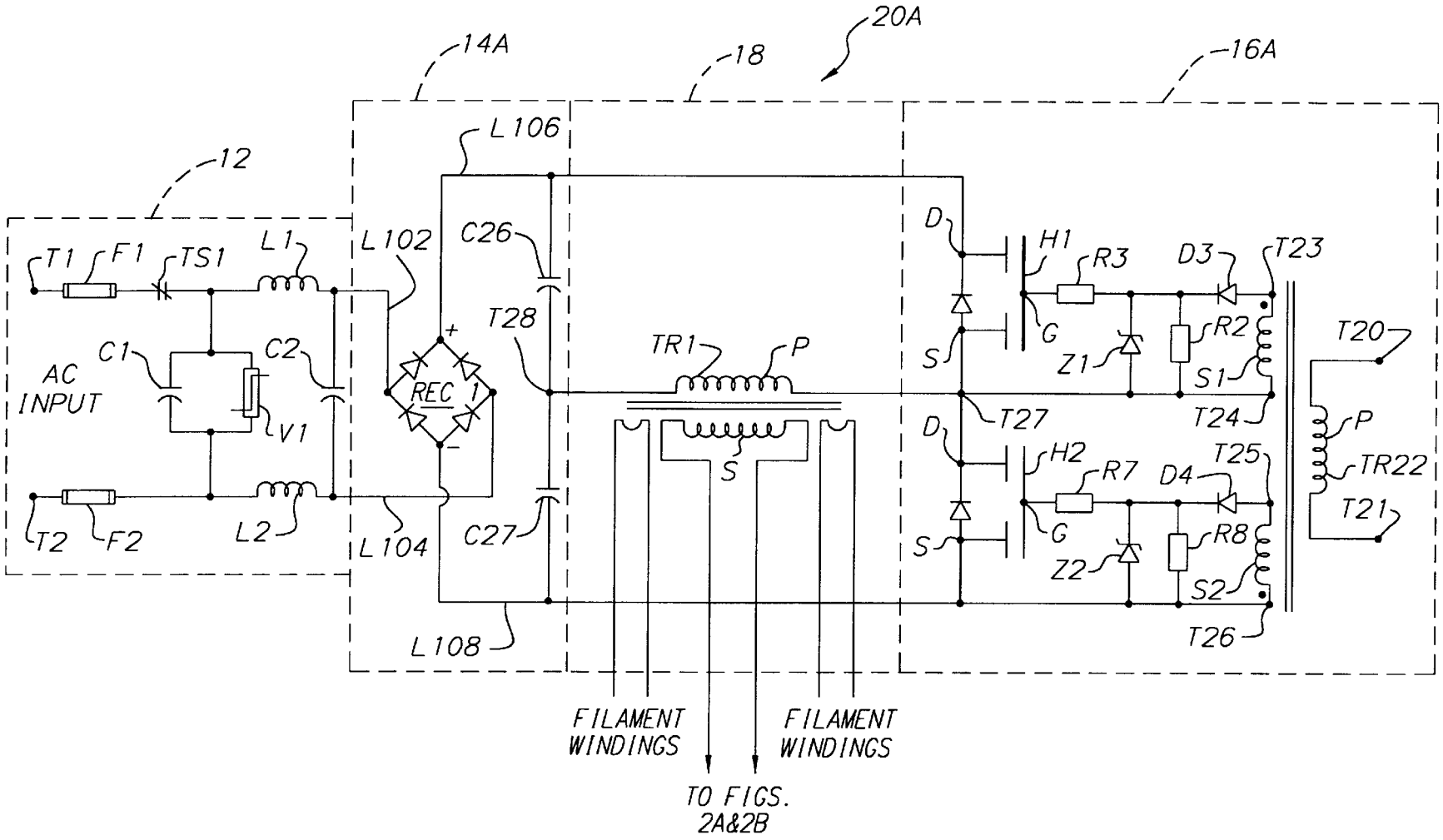
FIG. 3A is a circuit diagram for one portion of a dimmable electronic ballast constructed in accordance with this invention.
Figure 3B:
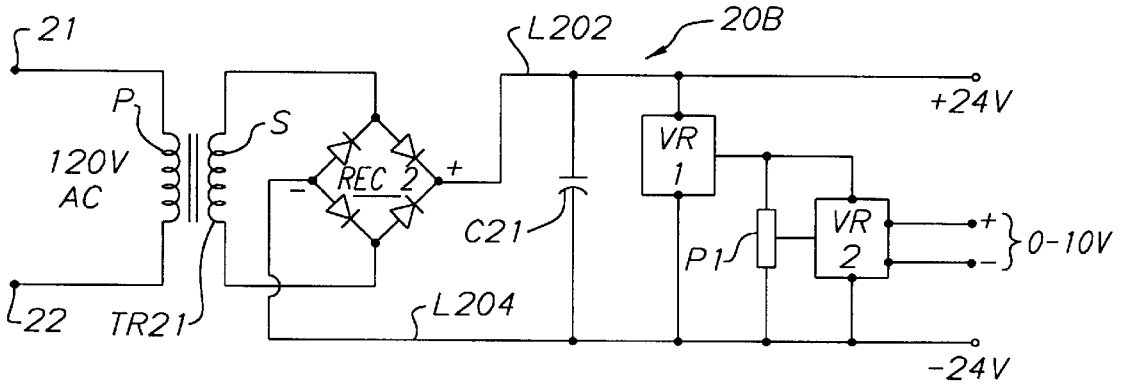
FIG. 3B is a schematic diagram of another portion of a dimmable electronic ballast constructed in accordance with this invention.
Figure 3C:
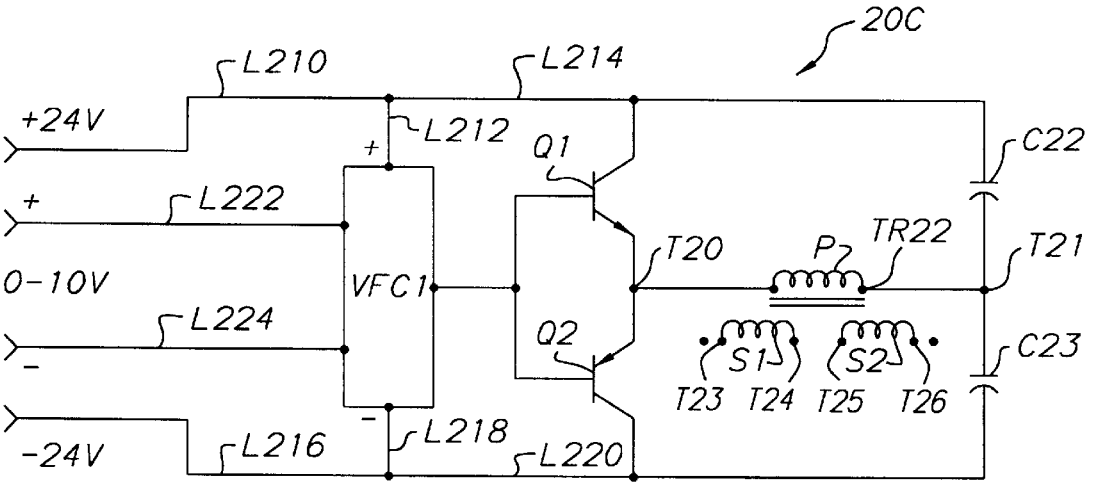
FIG. 3C is a schematic diagram of one embodiment of another portion of a dimmable electronic ballast constructed in accordance with this invention.
Figure 3D:
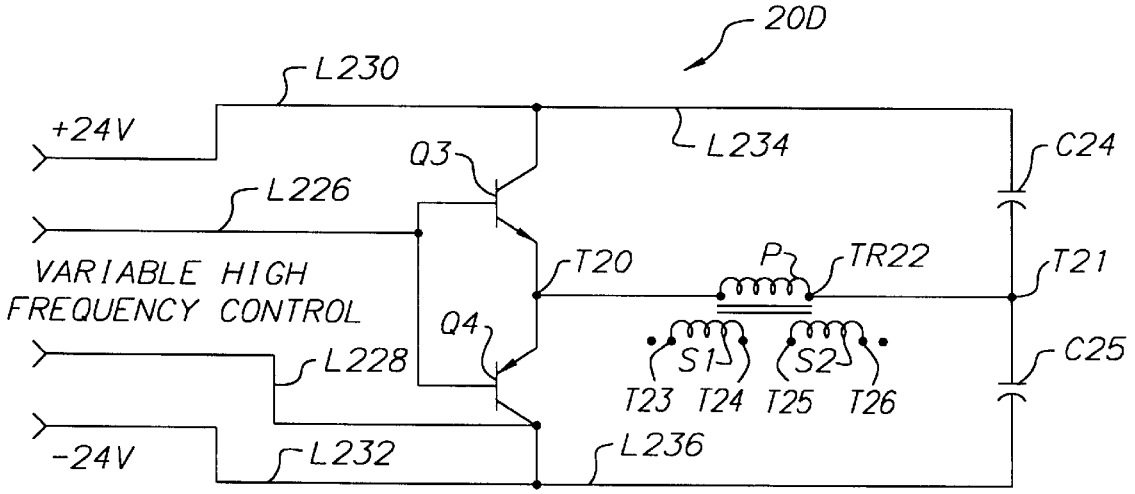
FIG. 3D is a schematic diagram of another embodiment of another portion of a dimmable electronic ballast constructed in accordance with this invention.

To summarize, the circuit 20A of FIG. 3A and the circuits 20C and 20D, of FIGS. 3C and 3D, respectively, are always located at the remote locations of the lamps, while the circuit of 20B of FIG. 3B can be located at a central location to either provide regulated DC voltages to the circuit 20C or, with the addition of a voltage-to-frequency convertor, to provide variable high frequency inputs to the circuit 20D of FIG. 3D.

It should also be noted that in all the dimmable embodiments described above, the secondary and the filament windings of the output transformer TR1 of circuit 20A (FIG. 3A) are connected to the lighting loads as shown in FIGS. 2A and 2B in the same manner as in the non-dimmable ballast embodiment.

As can be seen in FIG. 3A, one embodiment of a dimmable ballast 20 includes the same protection and DC filter section 12 and output transformer section 18 as does the non-dimmable ballast 10. It also includes a rectifier section 14A and an inverter section 16A. The rectifier section 14A is slightly different than the section 14 of the non-dimmable ballast in that the output of the rectifier REC1 provided on the lines L106 and L108 is bridged by two capacitors C26 and C27 instead of the single capacitor-resistor combination R3 and R1 of the ballast 10.

The dimmable ballast inverter section 16A of the circuit 20A is similar in some respects and different in other respects from the inverter section 16 of the non-dimmable ballast 10. In this regard, the inverter section 16A employs the same two HEXFETs as the ballast 10 except that the inverter section 16A does not have a tuned circuit parallel combination of the tapped inductor L4 and the capacitor C4 in the non-dimmable 10. Rather, as will be explained in detail later, the inverter section 16A receives a variable high frequency input from a transformer TR22 forming a portion of a control circuit 20C.

Referring now to the FIGS. 3A–3D, it can be seen in FIG. 3A that the protection and noise filter section 12 for the non-dimmable ballast 20 of FIG. 3A is identical to the protection and noise filter section 12 of the dimmable ballast. Therefore, the detailed description of the operation of the section 12, which was given previously for the non-dimmable ballast 10 of FIG. 1 will not be repeated at this time.

The rectifier REC1 of the rectifier section 14A of the dimmable ballast is the same as the rectifier REC1 of the non-dimmable ballast 10. The rectifier REC1 provides a DC voltage on lines L106 and L108. This voltage is approximately equal to 1.414 times the RMS AC input voltage. A pair of serially connected capacitors C26 and C27 are connected between the lines L106 and L108. The junction between the capacitors C26 and C27 is connected to one terminal T28. This terminal is connected to one side of the primary P of the output transformer TR1. The lines L106 and L108 also serve as inputs to the inverter section 16A. That section is similar to the inverter section 16 of the non-dimmable ballast, except that it does not include the tuned resonant circuit. Thus, it includes the two power MOSFETs, e.g., HEXFETs H1 and H2, and their associated components (the details of their construction and operation will not be reiterated). The lines L106 and L108 are connected to the drain D of the HEXFET H1 and the source S of the HEXFET H2, respectively. The junction of the drain D of the HEXFET H2 and the source S of the HEXFET H1 is connected to a terminal T27. The terminal T27 is connected to the other side of the primary P of the output transformer TR1.

It should be noted that the inverter 16A is shown in FIG. 3A as including the transformer TR22 having a primary winding P and a pair of secondary windings S1 and S2 for ease of understanding of the invention. In actuality, the transformer TR22 and its windings form a part of either of the circuits 20C and 20D of FIGS. 3C and 3D, respectively. Thus, the ends of the primary winding P of the transformer TR22 are connected to the terminals T20 and T21 in the circuits 20C and 20D (FIGS. 3C and 3D, respectively), as will be described later, depending upon the embodiment of the dimmable ballast desired. The polarities of the secondary windings S1 and S2 of the transformer TR22 is as shown in FIG. 3A. The winding S1 is connected between a pair of terminals T23 and T24 in the inverter circuit 16A. In particular, terminal T23 is connected to the anode of the diode D3, while the terminal T24 is connected to the junction of one side of the resistor R2, the anode of the zener diode Z1, the source S of the HEXFET H1 and the terminal T27. The winding S2 is connected between a pair of terminals T25 and T26 in the inverter circuit 16A. In particular, the terminal T25 is connected to the anode of the diode D4, while the terminal T26 is connected to the junction of one side of the resistor R8, the anode of the zener diode Z2 and the source S of the HEXFET H2.

The HEXFETs H1 and H2 receive a variable high frequency input signal from the primary P of the transformer TR22 through its secondary windings S1 and S2. The primary P of the transformer TR22 is supplied with a voltage square wave at a frequency in the range of 20 KHz to 250 KHz in order to vary the light intensity output from the fluorescent lamps making up the load. The secondary windings S1 and S2 of the transformer TR22 are connected at terminals T23 and T25 to the diodes D1 and D2 to alternately supply positive voltages to the gates of HEXFETs H1 and H2, respectively. When the HEXFET H1 turns on, current from the positive terminal capacitor C26 flows through the HEXFET H1 to the terminal T27 then through the primary P of the output transformer TR1 to the terminal T28 and then to the negative side of the capacitor C26. This partially discharges the capacitor C26, which is then recharged from the rectifier REC1.

When the HEXFET H1 is turned off by the removal of its positive gate pulse, via diode D3, then diode D4 supplies a positive signal to the gate G of the HEXFET H2 which turns that HEXFET H2 on. When the HEXFET H2 turns on, the capacitor C27 causes current to flow from its positive side to the terminal T28, then through the primary P of the output transformer TR1 to the terminal T27, then through the HEXFET H2 to the negative side of the capacitor C27. Thus, the HEXFET H1 and the HEXFET H2 are turned on alternately. As soon as the HEXFET H1 turns off, current reverses direction in the primary winding of the output transformer TR1, thereby reversing the polarity of the voltage on its secondary winding S and on the filament windings. The resistors R2 and R8 are used to remove the capacitance charge from the gates G of the HEXFETs H1 and H2 when diodes D3 and D4 stop conducting and to keep the gate voltages at approximately 0 volts until the voltage from the secondary windings S1 and S2 become positive. The resistors R3 and R7 are used to prevent high frequency parasitic voltages from appearing at the gates G of the HEXFETs H1 and H2. The zener diodes Z1 and Z2 clamp the gate voltage to a level which will protect and not damage the HEXFETs H1 and H2.

Referring now to FIGS. 3B, 3C and 3D the generation of the variable high frequency voltages provided to the circuit 20A of FIG. 3A by the transformer TR22 from the control circuit 20B and an associated circuit, either 20C or 20D, will now be described.

As mentioned earlier in the "first" embodiment of the dimmable ballast of this invention, the circuits 20B and 20C of FIGS. 3B and 3C are located at the lamps, together with the circuit 20A of FIG. 3A. In this configuration, the circuits 20A, 20B and 20C are used to drive only one bank or load of two or four lamps, e.g., the loads of FIGS. 2A and 2B.

Referring now to FIG. 3B it can be seen that the control circuit 20B comprises a step-down transformer TR21, a full wave diode bridge rectifier REC2, a first voltage regulator VR1, a potentiometer P1, and a second voltage regulator VR2. These components serve to provide a regulated ±24 volt DC output and a regulated ±0–10 volt DC output for use by the circuits 20C or 20D of FIGS. 3C and 3D, respectively. A smoothing and filter capacitor C21 is connected across the output terminals of the bridge rectifier REC2. These terminals are connected to lines L202 and L204. The voltage regulator VR1 is a conventional solid state device which is connected across the ±24V and −24V outputs of the rectifier REC2, via lines L202 and L204, respectively. The AC input to the rectifier REC2 is provided via the step-down transformer TR21. That transformer comprises a primary winding P and a secondary winding S. The ends of the primary P are connected to a pair of terminals 21 and 22 to which the conventional 50–60 Hz AC power is provided. The ends of the secondary are connected to the AC terminals of the bridge rectifier REC2.

The positive output of the voltage regulator VR1 is connected to one side of the potentiometer P1, with the other side of the potentiometer being connected to the −24V output. The moveable contact of the potentiometer P1 is connected to the input of the second voltage regulator VR to stabilize the regulated voltage and to present a low impedance voltage source when the control circuit 20B is used to supply plural banks or loads of plural lamps via plural circuits 20C of FIG. 3C.

Referring now to FIG. 3C the details of the circuit 20C will now be described. As can be seen that circuit basically comprises a conventional solid state, variable, voltage-to-frequency converter (i.e., an integrated circuit chip), VFC1, and a pair of transistors Q1 and Q2. The voltage-to-frequency converter VFC1 receives the fixed ±24 volt and variable ±0–10 volt inputs from the output of the control circuit 20B and generates an output signal whose frequency varies in relation to the level of the 0–10 volt input it receives. The output of the voltage-to-frequency converter VFC1 is applied to the bases of the transistors Q1 and Q2. These transistors are connected in a push-pull arrangement across the 24 volt input. In particular, the ±24V input is connected by lines L210 and L212 to the ±24V input terminals of the voltage-to-frequency converter VFC1, and by lines L210 and L214 to the collector of the transistor Q1. The −24V input is connected by lines L216 and L218 to the −24V terminal of the voltage-to-frequency converter VFC1. The −24V input is connected by lines L216 and L220 to the collector of the transistor Q2. The positive and negative sides of the 0–10 input are connected, via lines L222 and L224, respectively, to the low voltage input terminals of the voltage-to-frequency converter VFC1.

The transistors Q1 and Q2 provide high frequency power to the primary P of the output transformer TR22. As mentioned earlier, the output transformer TR22 includes two secondary windings S1 and S2 which are coupled via terminals T23, T24, T25 and T26 to the gates of the HEXFETs H1 and H2 as shown in FIG. 3A. The emitters of the transistors Q1 and Q2 are connected together to one side of the primary winding P of the transformer TR22, while the other side of the primary winding P of that transformer is connected, via a capacitor C22, to the collector of the transistor Q1. It is also connected to the ±24V input via lines L214 and L210. The same side of the primary P of the transformer TR2 which is connected to the capacitor C22 is also connected, via another capacitor C23, to the collector of the transistor Q2 and also to the −24V input, via lines L220 and L216.

When the dimmable ballast is configured to allow for a centralized dimmer control, i.e., control from a central location remote from the location of the fluorescent lamps, the control circuit 20B, which is shown in FIG. 3B, is located at that central location. In this "second" embodiment of the dimmable ballast the circuits 20A and 20C form a unit for location at the lamps. The variable ±0–10 volt and the fixed ±24 volt outputs are used to effect the dimming control banks of plural lamps, e.g., banks as configured such as shown in FIGS. 2A and 2B. Thus, in this embodiment a plurality of circuit 20C of FIG. 3C are used, and each is connected to a common circuit 20B via a four conductor, shielded cable. It should be understood that in the "first" embodiment of the dimmable ballast, i.e., the circuits 20A, 20B and 20C all being in a unit located at the lamps, the control circuit 20B is used with only one circuit 20C to which only one bank or load of lamps is connected.

FIG. 3C shows an alternative circuit to the circuit 20C of a dimmable ballast constructed in accordance with this invention. That alternative circuit is designated by the reference numeral 20D and is quite similar in construction to the circuit 20C shown in FIG. 3C except that it does not include the voltage-to-frequency converter VFC1. However, a voltage-to-frequency converter (not shown) is included in the circuit 20B and wired to the variable ±0–10 volt and ±24 volt outputs of that circuit. This arrangement forms the "third" embodiment of the dimmable ballast of this invention. In this embodiment a variable high frequency signal is provided via a coaxial cable (not shown) to a plurality of circuits 20D each of which operate a respective bank of plural fluorescent lamps, using a plurality of circuits 20A.

The circuit 20D basically comprises a pair of transistors Q3 and Q4 connected in a push-pull configuration. The emitters of transistors Q3 and Q4 are connected together to one side of the primary winding P of the transformer TR22. The output transformer TR22 includes the secondary windings S1 and S2 which are connected to the circuit 20A. The bases of the transistors Q3 and Q4 are connected together and to high frequency input line L226. The emitters of the transistors Q3 and Q4 are connected together and to one side of the primary winding P of the transformer TR22. The other side of the primary winding P of the transformer TR22 is connected through a capacitor C24 and a line L234 to a line L230 and to the collector of transistor Q3. The line L230 constitutes the ±24V input. The same side of the primary winding P to which capacitor C24 is connected, is connected through a capacitor C25 and a line L236 to a line L232 and to the collector of the transistor Q4. The line L232 is the −24V input.

The variable high frequency input to the circuit 20D is provided via the lines L226 and L228. The line L226 is connected to the common junction of the bases of the transistors Q3 and Q4. The line L228 is connected to the collector of the transistor Q4 and to the −24V line L232.

It should be noted that with the interconnected winding W1 and W2 of reactor L4, wound about the core of L4 as previously described for very low distributed capacity, the dimmable ballasts of this invention will not have resonant frequencies which may cause sudden brightness or dimming of the lamps as the frequency is adjusted to adjust the level of lamp illumination.

As should be appreciated from the foregoing, the non-dimmable ballast 10 of this invention utilizes a unique oscillatory circuit comprising a tapped inductor in parallel with a capacitor in combination with two HEXFETs to provide sufficient power to operate a bank of plural fluorescent lamps (e.g., either two or four fluorescent lamps).

Significant safety features are incorporated in both the dimmable and non-dimmable ballasts by using fuses in both of the input lines from the AC power source, in addition to a thermal protection switch. Providing fuses in both legs of the input power lines protects against dangerous situations occurring when the input power leads are wired incorrectly, i.e., the hot side to the neutral and the neutral to the hot side, and there is an equipment failure or short circuit which would make the chassis hot. Also the use of an isolated secondary winding on the output transformer eliminates the possibility of shock or electrocution from touching of the exposed sockets when the lamps are being changed or removed.

The non-dimmable ballast of this invention uses considerably less components than existing ballasts and is safer, simpler, more reliable, and less expensive than prior art ballasts.

Also described have been dimmable ballasts, with the dimmer control incorporated in each of the ballasts, Alternatively the dimmable ballast may include the dimmer control at the central location capable of operating one or more banks of plural fluorescent lamps. The dimmable ballast circuitry has means for preventing the occurrence of resonance at frequencies over the frequency range by providing an output circuit connected to the lamps which has very low distributed capacity.

Finally, both the dimmable and non-dimmable ballasts can operate either two lamps in series or four lamps in a series, parallel configuration.

Without further elaboration, the foregoing will so fully illustrate my invention and others may, by applying current or future knowledge, readily adapt the same for use under various conditions of service.

I claim:

1. An electronic ballast for operating a lighting load of at least two fluorescent lamps, said ballast comprising:

(a) a protection and noise filter circuit arranged to be connected to an AC power source;

(b) a rectifier and DC filter circuit coupled to said protection and noise filter circuit to provide DC power;

(c) an inverter circuit coupled to said rectifier and DC filter circuit for receipt of said DC power therefrom, said inverter circuit including a tuned resonant circuit comprising a first capacitor connected in parallel with a tapped inductor to generate a fixed high frequency electrical signal, said inverter circuit requiring no feedback signal from any one of said at least two fluorescent lamps to generate said fixed high frequency electrical signal; and (d) an output circuit comprising an output transformer coupled to said lamps and arranged for receipt of said fixed high frequency electrical signal from said inverter circuit, said output circuit further comprising a reactor connected to said output transformer and to said lamps, said reactor having a core and a pair of windings wound about said core in a manner which reduces the distributed capacitance at the connection between said reactor, said output transformer and said lamps.

2. The electronic ballast of claim 1 wherein said reactor is connected to and provides power for operating two or four fluorescent lamps, and wherein each of said windings has a first and a second end, with said first ends being connected together and with said second ends being connected to said lamps, said windings being wrapped around said core with said first ends being close to said core and with said second ends being further from said core than said first ends.

3. An electronic ballast for operating a lighting load of at least two fluorescent lamps, said ballast comprising:

(a) a protection and noise filter circuit arranged to be connected to an AC power source;

(b) a rectifier and DC filter circuit coupled to said protection and noise filter circuit to provide DC power;

(c) an inverter circuit coupled to said rectifier and DC filter circuit for receipt of said DC power therefrom, said inverter circuit including a tuned resonant circuit comprising a first capacitor connected in parallel with a tapped inductor to generate a fixed high frequency electrical signal, said inverter circuit requiring no feedback signal from any one of said at least two fluorescent lamps to generate said fixed high frequency electrical signal; and (d) an output circuit comprising an output transformer coupled to said lamps and arranged for receipt of said fixed high frequency electrical signal from said inverter circuit, said tapped inductor including a plurality of taps and wherein said inverter circuit comprises a first power MOSFET and a second power MOSFET, each of said MOSFETs being coupled to respective taps of said tapped inductor.

4. An electronic ballast for operating a lighting load of at least two fluorescent lamps, said ballast comprising:

(a) a protection and noise filter circuit arranged to be connected to an AC power source;

(b) a rectifier and DC filter circuit coupled to said protection and noise filter circuit to provide DC power;

(c) an inverter circuit coupled to said rectifier and DC filter circuit for receipt of said DC power therefrom, said inverter circuit including a tuned resonant circuit comprising a first capacitor connected in parallel with a tapped inductor to generate a fixed high frequency electrical signal, said inverter circuit requiring no feedback signal from any one of said at least two fluorescent lamps to generate said fixed high frequency electrical signal; and (d) an output circuit comprising an output transformer coupled to said lamps and arranged for receipt of said fixed high frequency electrical signal from said inverter circuit, said output circuit comprising an output transformer having a primary winding, a secondary winding, and a reactor comprising a core, a first winding and a second winding, each of said windings having a first and a second ends, with said first ends being connected together, and with said windings being wound about said core with said first ends being close to said core and with said second ends being further from said core than said first ends.

5. The electronic ballast of claim 4 wherein said second ends of said first and second windings are connected to said secondary winding of said output transformer and to two fluorescent lamps connected in series.

6. The electronic ballast of claim 4 wherein said first ends of said first and second windings are connected to said secondary winding of said output transformer and said second ends of said first and second windings are each connected to a respective one of two sets of two fluorescent lamps connected in series, with said sets being connected in parallel to each other.

7. A dimmable electronic ballast for a lighting load of at least two fluorescent lamps, said ballast being arranged to be connected to an AC power source and comprising, a control circuit having a dimming control, a voltage-to-frequency conversion circuit connected to said control circuit, a protection and noise filter circuit, a rectifier circuit, an inverter circuit, and an output circuit, said voltage-to-frequency conversion circuit providing an output signal of a variable frequency in response to said dimming control, said frequency being in the range of approximately 20 to 250 KHz, said ballast additionally comprising means for preventing resonant frequencies over said range, said voltage-to-frequency conversion circuit requiring no feedback signal from any one of said at least two fluorescent lamps;

wherein said control circuit, said voltage-to-frequency conversion circuit, said protection and noise filter circuit, said rectifier circuit, said inverter circuit and said output circuit are all located at said lamps and wherein said ballast system comprises means for illuminating a bank of two lamps or a bank of four lamps; and wherein said output circuit comprises an output transformer having a primary winding, a secondary winding, and a reactor comprising a core, a first winding and a second winding, each of said windings having a first and a second ends, with said first ends being connected together, and with said windings being wound about said core with said first ends being close to said core and with said second ends being further from said core than said first ends.

8. The dimmable ballast of claim 7 wherein said second ends of said first and second windings are connected to said secondary winding of said output transformer and to two fluorescent lamps connected in series.

9. The dimmable ballast of claim 7 wherein said first ends of said first and second windings are connected to said secondary winding of said output transformer and said second ends of said first and second windings are each connected to a respective one of two sets of two fluorescent lamps connected in series, with said sets being connected in parallel to each other.

10. The dimmable ballast system of claim 7 wherein said secondary winding is isolated from said primary winding and said AC power source.

11. A dimmable electronic ballast for a lighting load of at least two fluorescent lamps, said ballast being arranged to be connected to an AC power source and comprising, a control circuit having a dimming control, a voltage-to-frequency conversion circuit connected to said control circuit, a protection and noise filter circuit, a rectifier circuit, an inverter circuit, and an output circuit, said voltage-to-frequency conversion circuit providing an output signal of a variable frequency in response to said dimming control, said frequency being in the range of approximately 20 to 250 KHz, said ballast additionally comprising means for preventing resonant frequencies over said range, said voltage-to-frequency conversion circuit requiring no feedback signal from any one of said at least two fluorescent lamps;

said control circuit being located at a central location, and wherein said voltage-to-frequency conversion circuit, said protection and noise filter circuit, said rectifier circuit, said inverter circuit, and said output circuit are all located in a first location with said lighting load, said first location being remote from said central location; and said output circuit comprising an output transformer having a primary winding and a secondary winding, and a reactor comprising a core, a first and a second winding, each of said windings having a first and a second end, with said first ends being connected together, said windings wound about said core with said first ends being close to said core and with said second ends being further from said core than said first ends.

12. The dimmable ballast of claim 11 wherein said second ends of said first and second windings are connected to said secondary winding of said output transformer and to two fluorescent lamps connected in series.

13. The dimmable ballast of claim 11 wherein said first ends of said first and second windings are connected to said secondary winding of said output transformer and said second ends of said first and second windings are each connected to a respective one of two sets of two fluorescent lamps connected in series, with said sets being connected in parallel to each other.

14. A dimmable electronic ballast for a lighting load of at least two fluorescent lamps, said ballast being arranged to be connected to an AC power source and comprising, a control circuit having a dimming control, a voltage-to-frequency conversion circuit connected to said control circuit, a protection and noise filter circuit, a rectifier circuit, an inverter circuit, and an output circuit, said voltage-to-frequency conversion circuit providing an output signal of a variable frequency in response to said dimming control, said frequency being in the range of approximately 20 to 250 KHz, said ballast additionally comprising means for preventing resonant frequencies over said range, said voltage-to-frequency conversion circuit requiring no feedback signal from any one of said at least two fluorescent lamps;

said control circuit and said voltage-to-frequency conversion circuit both being located at a central location, and wherein said protection and noise circuit, said rectifier circuit, said inverter circuit, and said output circuit are all located as a first unit in a first location with a first lighting load at said first location, and wherein at least one other protection and noise circuit, rectifier circuit, inverter circuit, and output circuit are provided located as a second unit in a second location with a second lighting load at said second location; and said output circuit comprising an output transformer having a primary winding and a secondary winding, and a reactor comprising a core, a first and a second winding, each of said windings having a first and a second end, with said first ends being connected together, said windings wound about said core with said first ends being close to said core and with said second ends being further from said core than said first ends.

15. The dimmable ballast of claim 14 wherein said second ends of said first and second windings are connected to said secondary winding of said output transformer and to two fluorescent lamps connected in series.

16. The dimmable ballast of claim 14 wherein said first ends of said first and second windings are connected to said secondary winding of said output transformer and said second ends of said first and second windings are each connected to a respective one of two sets of two fluorescent lamps connected in series, with said sets being connected in parallel to each other.

* * * * *

UNITED STATES PATENT AND TRADEMARK OFFICE

CERTIFICATE OF CORRECTION

PATENT NO. : 5,825,137

DATED : October 20, 1998

INVENTOR(S) : Charles H. Titus

It is certified that error appears in the above-identified patent and that said Letters Patent is hereby corrected as shown below:

Col. 11, line 33, delete "non-".

Col. 11, line 34, replace "dimmable" with --non-dimmable--.

Col. 11, line 35, after the word "ballast", insert --20--.

Col. 12, line 27, replace "D1 and D2" with --D3 and D4--.

Col. 13, line 67, replace "TR2" with --TR22--.

Col. 15, line 23, replace "ballasts," with --ballasts.--

Col. 15, line 24, add a--,-- after "natively".

Signed and Sealed this

Second Day of February, 1999

*Attest:*

*Attesting Officer*

*Acting Commissioner of Patents and Trademarks*